United States Patent [19]

Swift

[11] 4,309,957

[45] Jan. 12, 1982

[54] WICK FOR DISPENSING FUSER OIL

[75] Inventor: Joseph A. Swift, Union Hill, N.Y.

[73] Assignee: Xerox Corporation, Stamford, Conn.

[21] Appl. No.: 756,212

[22] Filed: Jan. 3, 1977

[51] Int. Cl.[3] ..... G03G 15/10

[52] U.S. Cl. ..... 118/60; 118/260; 118/266; 432/60

[58] Field of Search ..... 118/60, 70, 266, 101, 118/260; 28/107, 108; 432/60; 219/216

[56] References Cited

U.S. PATENT DOCUMENTS

| | | | |
|---|---|---|---|
| 2,840,881 | 7/1958 | Bateman | 28/107 X |
| 3,090,099 | 5/1963 | Smith | 28/108 |
| 3,718,116 | 2/1973 | Thettu | 118/60 X |
| 3,799,401 | 3/1974 | Braun et al. | 118/60 X |
| 3,831,553 | 8/1974 | Thettu | 118/266 |

*Primary Examiner*—John P. McIntosh

*Attorney, Agent, or Firm*—Ronald Zibelli; John E. Beck; James F. Tao

[57] ABSTRACT

An improved fluid applicating wick for use in applying release fluids to a fuser member surface of a fusing system for fusing toner images is described. The wick comprises a working surface material which contacts the fuser member surface, and a backing material to which the working surface material is needled. A preferred fluid applicating wick comprises a layer of Teflon felt or fiber as a working surface material is needled to a fibrous or felted Nomex material.

2 Claims, 4 Drawing Figures

WICK FOR DISPENSING FUSER OIL

BACKGROUND OF THE INVENTION

This invention relates generally to fusing systems utilized for pressure fixing toners at elevated temperatures in electrostatic copying devices and more particularly to an improved wick member for applying release fluid to fuser members in such fusing systems.

In the process of xerography a light image of an original to be copied is typically recorded in the form of a latent electrostatic image upon a photosensitive member with subsequent rendering of the latent image visible by the application of electroscopic particles, commonly referred to as toner. The visual toner image can be fixed directly upon the photosensitive member or transferred from the member to another support, such as a sheet of plain paper, with subsequent affixing of the image thereto. Toners are well known in the art and may be of various types.

In order to affix or fuse electroscopic toner material onto a support surface permanently by heat, it is necessary to elevate the temperature of the toner material to a point at which the constituents of the toner material coalesce and become tacky. This action causes the toner to flow to some extent into the fibers or pores of support members of otherwise upon the surface thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

Several approaches to thermal fusing of electroscopic toner images onto a support have been described in the prior art and include providing the concomitant application of heat and pressure as by a roll pair maintained in pressure contact, a flat or curved plate member in pressure contact with a roll, a belt member in pressure contact with a roll, and the like. Heat may be applied by heating one or both of the rolls, plate members or belt members. The fusing of the toner takes place when the proper combination of heat, pressure and contact time are provided, the balancing of these parameters being well known in the art and varying according to various factors which must be independently determined for each particular situation.

During operation of a fusing system of the type where there is a thermal fusing of electroscopic toner images onto a support in which at least one fuser member, such as a roll, plate or belt, is heated, the support member to which the toner images are electrostatically adhered, is moved through the nip formed between the members with the toner image pressure contacting the fuser roll thereby to effect heating of the toner images within the nip. By controlling the heat transfer to the toner, virtually no offset of the toner particles from the copy sheet to the fuser member is experienced under normal conditions. This is because the heat applied to the surface of the fuser member is insufficient to raise the temperature of the surface of the member above the "hot offset" temperature of the toner at which temperature the toner particles in the image areas of the toner liquify and cause a splitting in the molten toner resulting in "hot offset". Splitting occurs when the cohesive forces holding the viscous toner mass together is less than the adhesive forces tending to offset it to a contacting surface such as a fuser roll, fuser belt, or fuser plate.

Occasionally, however, toner particles will be offset to the fuser roll by an insufficient application of heat to the surface thereof (i.e. "cold offsetting"); by imperfection in the properties of the surface of the roll; by the toner particles insufficiently adhering to the copy sheet; by the electrostatic forces which normally hold them there; or by the reactivity of the toner material itself in those cases where the toner is of a reactive nature. In such a case, toner particles may be transferred to the surface of the fuser member with subsequent transfer to the backup member which provides pressure contact, during periods of time when no copy paper is in the nip.

One arrangement for minimizing the foregoing problems, particularly that which is commonly referred to as "offsetting", has been to provide a fuser member with an outer surface or covering of polytetrafluoroethylene, known by the tradename Teflon, to which a release agent such as silicone oil, is applied. More recently, bare metal fuser members have been introduced for fusing or fixing the electroscopic toner materials to various surfaces. Various fluid polymer release materials which oxidize or which contain functional groups, can be utilized to prevent "offsetting". Exemplary of such systems are the disclosures in U.S. Pat. No. 3,937,637 and U.S. Pat. No. 3,918,804. Other release agents for bare metal fuser rolls are described in Belgium Pat. No. 831,662.

In the foregoing exemplary fusing systems the release agent or release fluid may be applied to the fuser member by means of a wick as described in U.S. Pat. No. 3,718,116, U.S. Pat. No. 3,831,553 and U.S. Pat. No. 3,841,827. The wick is generally used to dispense silicone oil, functional siloxane fluids, mineral oil, and many other release fluids upon the external surface to the fuser member in the form of a pad overlying and in contact with the fuser member which is heated during operation.

As described in the foregoing patents, the wick assembly generally includes two different layers. A first layer in contact with the surface of the fuser member meters precise amounts of release fluid thereon, while a second layer in contact with the first layer has high release fluid retention capabilities for supplying the first layer with the fluid. In a preferred embodiment, the wick comprises a layer of Teflon which contacts the surface of a fuser roll, and a second layer of Nomex which has its underside in contact with an applicator roll, the release fluid in a sump or some other fluid supply device or means. Teflon and Nomex are trademarks of E. I. du Pont de Nemours & Company of Wilmington, Delaware.

The prior art wick assemblies comprising two layers, such as Teflon and Nomex, are joined by stitching, clamping or cementing the layers together. These methods of fabricating the two layers have many disadvantages. First, these conventional wicks are relatively inefficient in transporting fluid, and there is relatively short wick like due to separation of significant portions of the two layers. Secondly, because of the tendency for layers of the prior art wicks to separate from each other, and because there is only surface to surface contact of the two layers with each other, there is low fluid transfer or through put from one layer to the other layer.

In the prior art methods of fabricating wick materials, there is also a tendency for the fibers in the layers to be loosely held, thereby causing accumulations of fuzz- (lint) and/or fibers in various machine parts. These can cause serious problems in copy quality, especially when the fibers accumulate in critical such as in metering areas resulting in non-uniform metering and oil streaks on copies. Toner build-up on these fibers is transferred back to subsequent copies as toner offset. In fact, the second layer is frequently flame treated prior to use in a fuser assembly to burn all loose fibers.

OBJECTS OF THE INVENTION

Accordingly it is the principal object of this invention to overcome the foregoing deficiencies in wicks made up of at least two layers of material.

Another object of this invention is to provide an improved release fluid wick applicator assembly for fusing systems in xerographic copying machines.

Still another object of this invention is to provide a multiple-layered wick material having an improved life.

Another object of this invention is to provide a multiple-layered wick material capable of high fluid through-put from layer to layer.

Another object of this invention is to provide a multiple-layered wick material having a reduced amount of loose fibrous material.

SUMMARY OF THE INVENTION

These and other objects of the instant invention are generally accomplished by a wick material having two or more layers, at least some of the material of at least one of the layers extending into the material of at least one of the layers. These improved composite wicks are useful for applying release fluid to the surface of a fuser member.

The release fluid applicators of the present invention comprise a working surface layer of a first material which contacts a fuser member surface and a fluid retention layer of a second material which contacts the working surface layer, at least some of the material of at least one of the layers extending into the material of the other layer, the first and second materials being different compositions.

The composite wicking material of the present invention comprising a first release fluid metering layer (the working surface) which contacts the fuser member surface, and a second release fluid retention layer adjacent the first layer and in contact therewith, constitutes a substantial improvement over the prior art wicking composites used in fuser assemblies, when at least some of the material of at least one of the layers extends into the material of the other layer. When a composite wick material was made in this manner, it was unexpectedly found that substantially higher release fluid through-put and uniform spreading of the release fluid on the fuser member was accomplished without sacrificing the functional or useful life of the composite wick material. In fact, it was discovered that the functional or useful life of the wick actually increased.

Exemplary of the method of extending some of the material of at least one of the layers into the material of the other layer is described in U.S. Pat. Nos. 2,840,831 and 3,090,099.

As used herein, working surface is defined as that surface or layer of the wick composite which contacts the fuser member surface.

Further objects of this invention together with additional features and advantages thereof will become apparent from the following detailed description of the preferred embodiments of the invention read in conjunction with the accompanying drawings.

DESCRIPTION OF THE PREFERRED EMBODIMENTS

Figure 3:
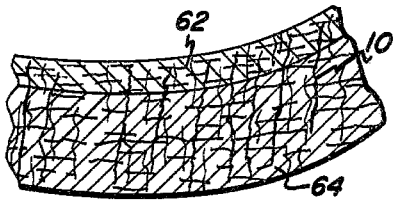
FIG. 3 is a diagrammatic illustration of a preferred composite wicking material used in the present invention.

The fuser embodiments of the present invention may be used in automatic xerographic reproducing machine which utilize a fuser member to which a release fluid is applied, for example, such as the automatic machines described in U.S. Pat. Nos. 3,718,116, 3,799,401 and 3,937,637 said patents being incorporated herein by reference. Therein are illustrated reproducing machines which employ an image recording drum-like or belt-like member, the outer periphery of which is coated with a suitable photoconductive material. The imaging member, either a photoconductive drum or belt is suitably mounted for advancing within a machine frame by means of a shaft which rotates or by means of a series of support shafts respectively, to bring the image retaining surface thereon past a plurality of xerographic processing stations. Suitable drive means are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are represented as stations A to E. Initially, the imaging member moves the photoconductive surface through a charging station A. At charging station A an electrostatic charge is placed uniformly over the photoconductive surface of the imaging member preparatory to imaging. The charging may be provided by a corona generating device of a type described in U.S. Pat. No. 2,836,725 issued to Vyverberg in 1958.

Thereafter, the imaging member is advanced to exposure station B where the charged photoconductive surface is exposed to a light image of the original input scene information, whereby the charge is selectively dissipated in the light exposed regions to record the original input scene in the form of a latent electrostatic image. A suitable exposure system may be provided by one skilled in the art.

After exposure the photoconductive imaging member advances the electrostatic latent image recorded on the photoconductive surface to development station C, wherein a conventional developer mix is applied to the photoconductive surface rendering the latent image visible. A suitable development station may include a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on the photoconductive surface is developed by bringing the brush of developer mix into contact therewith. The developed image on the photoconductive surface is then brought into contact with a sheet of final support material within a transfer station D and the toner image is transferred from the photoconductive surface to the contacting side of a final support sheet. The final support material may be plain paper, gummed labels, transparencies such as polycarbonate, polysulfone and Mylar, etc., as desired.

After the toner image has been transferred to the sheet of final support material, the sheet with the toner image thereon is advanced to a suitable fuser assembly which fuses the transfer powder image thereto. After the fusing process, the final support material is advanced by a series of rolls to a copy paper tray for subsequent removal therefrom by a machine operator.

Although most of the toner powder is transferred to the final support material, some residual toner remains on the photoconductive surface after the transfer of the toner powder image to the final support material. The residual toner particles remaining on the photoconductive surface after the transfer operation are removed from the imaging member as it moves through cleaning station E. Here the residual toner particles may first be brought under the influence of a cleaning corona generating device adapted to neutralize the electrostatic charge remaining on the toner particles. The neutralized toner particles are then mechanically cleaned from the photoconductive surface by conventional means as for example, the use of a resiliently based knife blade. Other cleaning modes may be used at cleaning station E as desired by one skilled in the art.

It is believed that the foregoing description is sufficient for purposes of present application to illustrate the general operation of an automatic xerographic copier which can embody the teachings of the present invention.

Fuser assemblies as used herein include cylindrical rolls, flat plates, curved plated, belts and the like. The fuser surface may be coated with various elastomers, or it may be a bare metal surface. For ease of description and applicable to all fuser members, emphasis herein is directed to a fuser assembly having a roll structure as a fuser member. The method of providing the necessary heat is not critical in the use of the improved composite wicking material of this invention, and the fuser members can be heated by internal means, external means, or both, all heating means being well known in the art for providing sufficient heat to fuse toner to its substrate.

Figure 1:
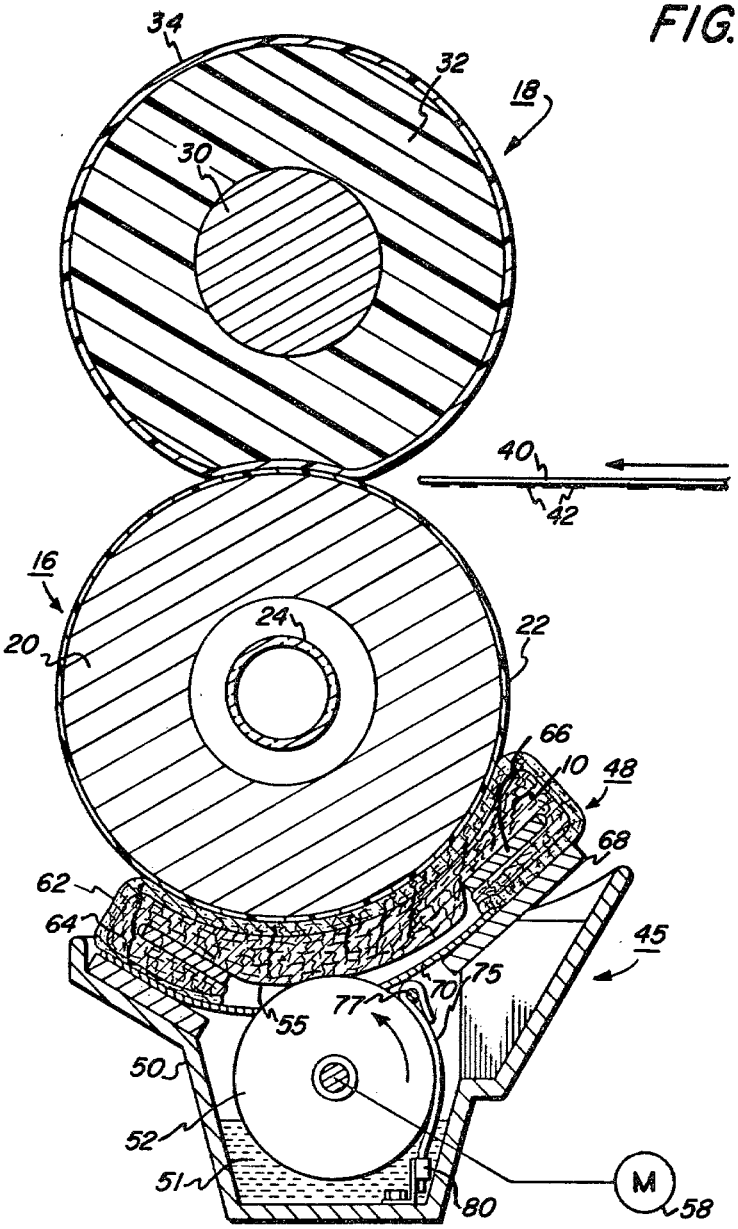
FIG. 1 is a side elevational view of a heated pressure fusing system embracing the improvement of the present invention.

Referring to FIG. 1, there is shown an exemplary environment for the needled composite fuser wick of the present invention. The heated pressure fuser assembly includes a heated fuser roll 16 and a backup pressure roll 18. Fuser roll 16 is a hollow circular cylinder with a metallic core 20 and a Teflon layer 22. A lamp 24 serves as a source of thermal energy and is located at the center of the fuser roll. Power to the lamp is controlled by a thermal sensor generally called a thermistor contacting the periphery of the fuser roll as described for example in U.S. Pat. No. 3,357,249. The backup roll 18 is also a circular cylinder and is made up of a metal core 30 surrounded by a thick rubber layer 32 and also a Teflon layer 34 to prevent soaking silicone oil into rubber layer 32 and subsequent swelling.

As a sheet of material 40 is advanced between the rolls 16 and 18 the toner image 42 on the support material will contact the peripheral heated surface of the roll 16 whereby the toner image becomes tackified and in this tackified condition the toner will tend to offset on this roll except that it is partially prevented from doing so by the Teflon coating on the roll. It is by the lubricating wick assembly 48 which is used to apply a thin film of offsetting preventing liquid such as silicone oil to the Teflon surface 22 of the fuser roll 16 that offset is prevented.

An oil applicator apparatus 45 includes lubricating wick assembly 48, an oil pan 50 for maintaining a supply of silicone oil 51 and an applicator roll 52. Other details relating to this embodiment may be found in U.S. Pat. No. 3,831,553.

In FIG. 1, applicator roll 52 is used to convey a thin film of oil to the bottom face 55 of lubricating wick assembly 48 as the applicator roll is rotated in the direction shown by the arrow. Desirably, applicator roll 52 is driven by an oil dispenser motor 58 which is energized during the fusing operation depending upon the number of copies being produced. In accordance with the present invention lubricating wick assembly 48 includes two different layers, a working surface layer of a first material 62 and a fluid retention layer of a second material 64 wherein at least some of the material of at least one of the layers extends into the material of the other layer. Strands or filaments indicated by numeral 10 represent the material of at least one layer extending into the material of the other layer. In a preferred embodiment, layer 62 is fibrous Teflon (polytetrafluoroethylene) and layer 64 is fibrous Nomex (a heat resistant nylon which is the copolymer of meta-phenylenediamine and isophthaloyl chloride), layer 62 being needled into 64 and represented by filaments or strands 10. Teflon and Nomex are trademarks of Du Pont Corporation, Wilmington, Delaware.

Layer 62 contacts the surface of fuser roll 16 and the underside of layer 64 contacts applicator roll 52. Layers 62 and 64 are assembled in overlapping relationship and their ends are clamped between plates 66 and 68 which are secured by any suitable means such as screws. Teflon is preferred as the upper layer because it has low coefficient of friction, low wear properties, low tendency to accumulate molten toner as well as thermal stability at elevated temperatures ranging up to 400° F. and above. Nomex is preferred as a lower layer because of thermal stability at elevated temperatures up to 400° F. and above and due to its high oil retention characteristics.

In FIG. 1, there is shown an auxiliary wick 75 which may be made out of any suitable wicking material and which supplies oil to wick assembly 48 through a sponge member. Auxiliary wick 75 is maintained in position by support member 77 and holding member 80. Details of this optional auxiliary wick are described in U.S. Pat. No. 3,831,553. Although it is not shown a metering blade may be used on the fuser member for uniformity of the release fluid layer.

Figure 2:
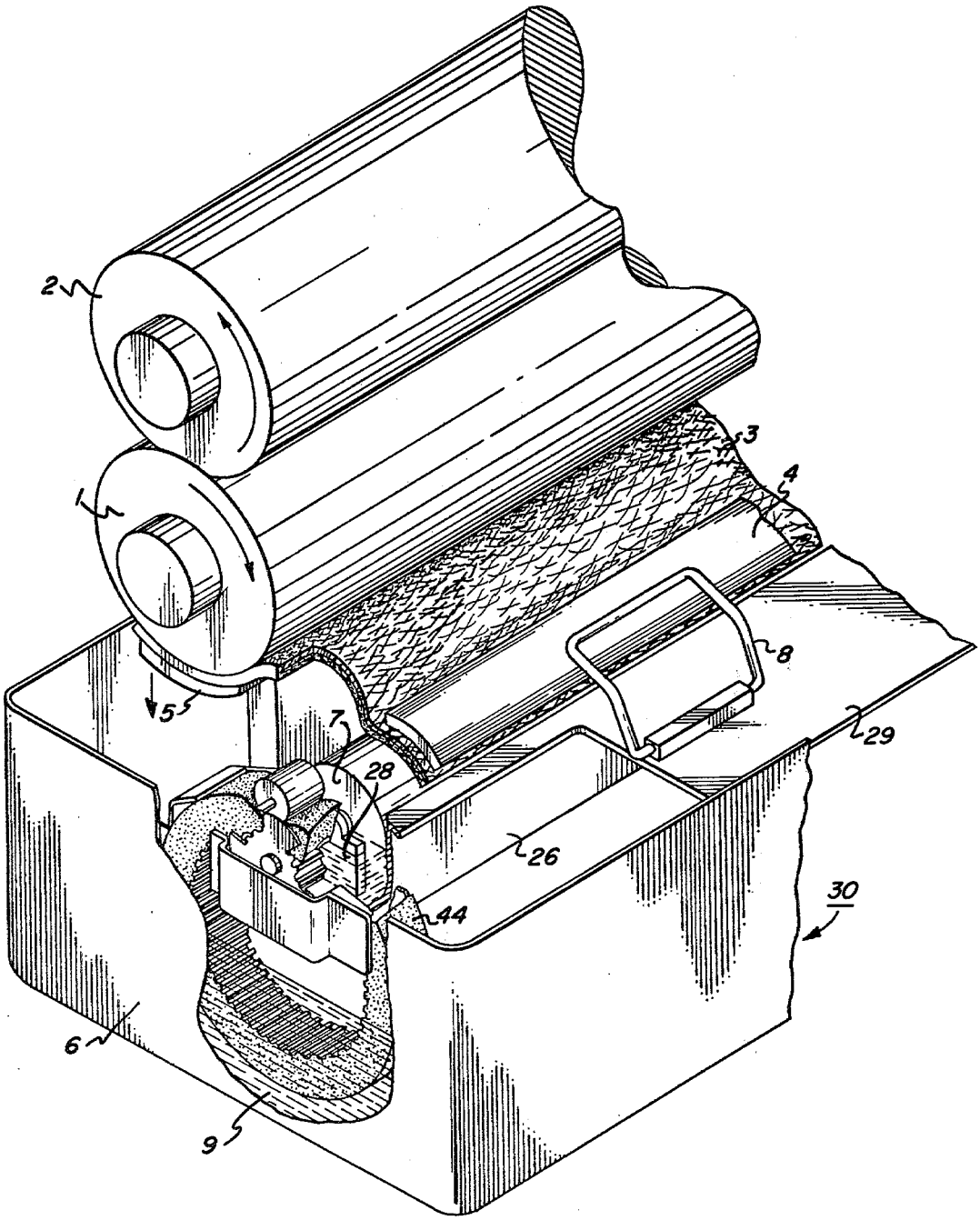
FIG. 2 is a perspective view of an alternative heated pressure fusing system embracing the improvement of the present invention.

Referring to FIG. 2, there is shown another exemplary fuser assembly environment for the needled composite fuser wick material of the present invention. Fuser roll 1 is supplied with release fluid from lubricator 30. Back-up roll 2 is in pressure contact with fuser roll 1 and forms a nip therewith through which the substrate carrying a toner image passes and becomes permanently affixed to the substrate by the heated fuser roll (not shown). Details of lubricator 30 and its operation are disclosed in U.S. Pat. No. 3,799,401. Lubricator 30 includes a supply reservoir 6 which contains a main supply of the lubricant which is to be applied to the fuser assembly. Lubricator 30 includes a dispensing reservoir 26 which is adapted to contain a predetermined volume 28 of release agent. A dispensing roller 7 is mounted on a shaft for rotation about a horizontal axis, and is partially immersed in the predetermined volume 28 of release agent. As the dispensing roller 7 rotates, a film of release agents adheres thereto and is conveyed to wick 3, the latter being biased against the dispensing roller by the weight of a curved plate 4. Plate 4 is mounted to a cover 29 by means of a hinge 8 so that the plate can be lifted when it is desired to remove the wick 3. In accordance with the present invention, wick 3 includes two different layers, a working surface layer of a first material and a fluid retention layer of a second material wherein at least some of the material of at least one of the layers extends into the material of the other layer. A magnified portion of the preferred wick material is shown in FIG. 3 and is described below. The wick 3 transmits the release agent from the dispensing roller 7 and applies to it a heated fuser roller 1 in the fuser assembly. This fuser roller is the one which contacts the powder image on the sheet of paper. To assure that the wick 3 maintains contact with the fuser roller 1, a wick support plate 5 biases the wick against the fuser roller. When it is desired to remove the wick 3, the support plate 5 is released and moved in the direction of the arrow.

To convey release agent from the supply reservoir 22 to the dispensing reservoir 26, an annular conveying member 44 is mounted within the supply reservoir. The conveying member 44 is comprised of a belt which is affixed by a suitable adhesive to an annular ring having teeth formed therein. The belt may be polyurethane or other suitable absorbent material. The details of conveying the release agent 9 to dispensing reservoir 26 are described in detail in U.S. Pat. No. 3,799,401.

Referring to FIG. 3, there is shown a fragmented view of a portion of a preferred composite wicking material having the characteristics of the present invention. The composite wick comprises a first material or layer 62 having a surface whih contacts the fuser member surface, and a second material or layer 64 one surface of which contacts the surface of layer 62 opposite that surface of layer 62 which contacts the fuser member surface and the other surface of which contacts the release agent or fluid supply means such as an applicator roll, a spray of release fluid, a reservoir of release fluid, and the like. In the present invention, at least some of the material of at least one of the layers must extend into the material of the other layer and the material of the two adjacent layers must be of different compositions. Thus, at least some of the material of layer 62 must extend into the material of layer 64 or at least some of the material of layer 64 must extend into the material of layer 64 or both. This is designated by numeral 10 in FIG. 3 which represents strands or filaments of material from layer 62 extending into the material of layer 64.

Figure 4:
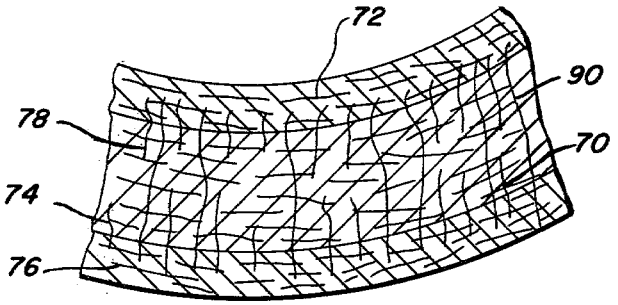
FIG. 4 is a diagrammatic illustration of a preferred three-layered composite wicking material used in the present invention.

Referring to FIG. 4, there is shown a fragmented view of a portion of a composite wicking material wherein at least some of the material of at least one layer extends into a second and third layer. The composite wick comprises a first layer or material 72, a second layer or material 74 and a third layer of material 76. At least some of the material of layer 72 extends into the material of layer 74 and is designated by numeral 78. At least some of the material of layer 72 extends into the material of layer 76 and is designated by numeral 90. Some of the material of layer 74 extends into the material of layer 76 and is designated by numeral 70.

The extending of the material of one layer into the material of the other layer is preferably accomplished by any of several well-known needling techniques such as described in U.S. Pat. Nos. 2,840,881 and 3,090,099, incorporated herein by reference. Therein is described the forming of a non-woven batt or layer of natural or synthetic staple fibers such as e.g. asbestos, wool, cotton, flax, jute, nylon, heat resistant nylons, viscose rayon, cellulose acetate, polyethyleneterephthalate, polyacrylonitrile, glass, polyvinylidene chloride and copolymers of polyvinylidene chloride with other monomers copolymerizable therewith. A batt or layer of non-woven polytetrafluoroethylene fibers is superposed over a non-woven fibrous batt or layer substantially free of polytetrafluoroethylene fibers and some of the polytetrafluoroethylene fibers are forcibly oriented angularly and/or perpendicular to the ultimate faces of the fibrous sheet. The perpendicularly oriented polytetrafluoroethylene fibers are extended into the non-woven batt or layer of non-polytetrafluoroethylene fibers to unite or combine the two separate batts or layers. Alternately the non-polytetrafluoroethylene fibers may be forced into the batt or layer of polytetrafluoroethylene fibers. To provide additional combining strength fibers from each batt may be forcibly extended and/or twisted into the other batt to increase fiber entanglements. Naturally it is within the scope of the present invention to provide a plurality of batts or layers to form the composite wick material having unexpectedly improved characteristics for applying release agents or fluids to fuser members in xerographic fuser assemblies. Any type of needle looming operation and needle profile may be used to extend the material of one or more layers into the material of one or more other layers.

Although non-woven intermingled fibers forming batts are preferred in the layers of the present invention, other types of batts and webs can be used in accordance with the present invention as long as the batts and webs lend themselves to the needling process or its equivalent whereby strands, filaments or fibers can be extended from one layer into at least the next adjacent layer. In preferred wick composites at least one of the materials is primarily of non-woven intermingled fibers or a web of loosely interlocked fibers. In the most preferred wick composite, all layers or materials are primarily non-woven intermingled fibers. It is deemed within the scope of the present invention to utilize layers of woven materials through which strands of filaments of adjacent layers or batts of non-woven fibrous materials, can be extended.

In the preferred utility of the composite wicking materials of the present invention, the first material (the working surface layer), that is the layer having a surface in contact with the fuser member, should have low friction, low affinity for molten toner and high thermal stability ranging up to 500° F., and the second material (the fluid retention layer) should have high thermal stability ranging up to 500° F.

The fibers which make up the major portion of the composite felt-like products may be selected from a large group of fibers and includes: asbestos, wool, cotton, polytetrafluoroethylene, flax, jute, glass, nylon, viscose rayon, cellulose acetate, heat resistant nylon, polyester, polyethylene terephthalate, polyacrylonitrile, polyvinylidene chloride and copolymers of vinylidene chloride with other monomers copolymerizable therewith such as e.g. acrylonitrile and vinyl chloride. Other fibrous materials and impregnated fibrous materials can also be used in the instant wick composites. Although the density of the felt-like materials is not critical a preferred density range of these materials, e.g. Nomex, is about 0.01 to about 1.0 grams/cc.

The denier of the fibers which may be used in carrying out this invention may vary. When polytetrafluoroethylene fibers are used as the first layer in contact with the fuser member, the preferred denier of the polytetrafluoroethylene fibers is less than 20; however, useful products can be made with much coarser fibers having a denier of 50 to 70, as well as fibers such as 3.0 denier or less. The denier of the fibers for the resilient batt to which the polytetrafluoroethylene fibers are attached may likewise vary over a wide range, there being no particular limits with respect to denier in either batt of fibers. The fibers may be straight or crimped. The length for the staple fibers forming the batt are not critical except for those limitations imposed by the card or other web forming apparatus. In the case of synthetic fibers forming the reinforcing woven fabric they may be formed from spun staple yarn or continuous filament yarn. The density of the polytetrafluoroethylene is not critical, the preferred density being about 0.5 grams/cc.

The relative thickness of the polytetrafluoroethylene batt and the batt substantially free of polytetrafluoroethylene fibers if not critical. However, in the preferred embodiment the layer of polytetrafluoroethylene fibers is thinner than the other batt of fibers. One of the important features of the fibrous felt-like products of this invention is the low surface friction combined with resiliency of the entire structure. In two preferred wick composite materials, the polytetrafluoroethylene layer (Teflon) is about 0.035 inch (0.089 cm.) thick and the heat resistant nylon layer (a copolymer of metaphenylenediamine) and isophthaloyl chloride known by the Du Pont trademark as Nomex is about 0.300 inch (0.84 cm.) thick or 0.6 inch (Nylon) and 0.375 inch (Nomex). The needle density in this preferred composite is about 3,000 perforations per square inch. Other preferred wick composites include fibrous polytetrafluoroethylene/wool and fibrous polytetrafluoroethylene/fibrous polyester.

By the terms "needling", "needle punching", "needle loomed", and "needle looming" as used throughout the specification and claims is meant forcibly oriented or orienting, respectively, fibers from one batt or layer into an adjacent batt or layer or into adjacent batts or layers by any method well known in the art.

The composite wick materials of the present invention may be used to apply any of the well-known fluid release agents applied to fuser members including bare metal or coated fuser rolls, plates, belts, and the like to prevent offsetting of toner especially heated or molten toner to the fuser member surface. The release materials or agents include mineral oil, peanut oil, silicone oil, and mixtures and blends of said oils with other materials, polymer release fluids including those which having functional groups such as the mercapto-functional polyorganosiloxanes, and those which oxidize to form functional groups thereon. The improved wick composites having a working surface layer exhibiting lubricity (low friction) and a fluid retention layer having a high capacity for retaining release fluids are generally in the form of a resilient fibrous sheet and provide an excellent supply of the release fluid at the surface of the fuser member and uniformly meter the release fluid in controlled amounts upon the surface of the fuser member. The strands or fibers extending from layer to layer provide integrity and strength to the composite, eliminate stitching which is a barrier to uniform metering of release fluid, reduce loose surface fibers and fuzz which interfere with doctoring and cleaning, and provide for excellent fluid transfer or through-put from one layer of the composite to the next layer.

The following examples further define and describe exemplary materials used as composite wick materials in a fuser assembly. The examples are intended to illustrate the various preferred embodiments of the present invention.

EXAMPLE I

Several stitched composite wick materials were used in test fixtures similar to the fuser assembly shown in FIG. 2. Silicone oil was used as the release fluid. Five different stitching configurations were used with wool, polyester and Nomex substrates covered with a working layer of Teflon. When compared with the non-stitched composite wick material of the present invention having an identical Teflon layer needled to the substrate layer, there was a 45–65% increase in the amount of silicone oil supplied to the fuser roll surface, the variation in the percentage improvement being dependent upon the material density. It was observed that the wicking rate for substrates tends to increase with a decrease in the density of the substrate layer. Thus, in accordance with this invention, a higher density wick can be used and can provide acceptable fluid application rates with a denser, stronger composite.

EXAMPLE II

Fuser wick composites were tested similar to Example I. A Teflon felt batt was stitched to a Nomex (heat resistant nylon) batt and a Teflon felt batt was stitched to a wool batt. The wicks were presoaked in silicone oil and placed in the fuser assembly fixture as in Example I. Dyed silicone oil was added to the pump, and the progress of the color was observed for each wick for fusing 30,000 copies. With stitched Teflon/wool composite the colored silicone oil barely reached the 14 inch (outer) edge of the fuser roll. The stitched Teflon/-Nomex composite wicks performed similar to the Teflon/wool composite, however, there was still an insufficient supply of the silicone oil to the outer edge of the fuser roll, that is, the full 14 inch width of the paper path.

EXAMPLE III

Needled wicks of Teflon/wool and Teflon/Nomex are tested as in Example II. Both needled composites performed superior to their counterparts in Example II. The needled wick composites meter or spread silicone oil substantially more uniformly across the entire 14 inch width of the fuser roll than the stitched wick composites.

EXAMPLE IV

Using a stitched Teflon/wool wick composite as in Example I, it was found that 31.1 microliters of silicone oil were transferred to each sheet of 14 inch copy paper. Under identical conditions a needled Teflon/wool wick composite provided 32.5 microliters of silicone oil for each sheet of copy paper. This results in a uniformity factor of 0.403 for the stitched wick composite versus 0.834 for the needled wick composite or an improvement of 107% in uniformity factor.

EXAMPLE V

Using a stitched and a needled Teflon/Nomex wick composite, both samples of Nomex having a density of 0.08 gram/cc, under conditions set forth in Example IV, the stitched composite supplied 59.50 microliters of silicone oil per copy of 14 inch paper and the needled composite supplied 62.67 microliters of silicone oil per copy of 14 inch paper. This is equivalent to a 121% increase in uniformity of metering of the needled composite over the stitched composite.

In accordance with the stated objects, an improved composite wick material has been demonstrated for metering and supplying silicone oil on fuser members.

While the invention has been described with respect to preferred embodiments, it will be apparent that certain modifications and changes can be made without departing from the spirit and scope of the invention and therefore, it is intended that the foregoing disclosure be limited only by the claims appended hereto.

What is claimed is:

1. In a fuser assembly where toner images produced by an electrostatic imaging and development system are fused by the application of heat and pressure comprising a fuser member, a pressure member, means to heat the fuser member, and wicking means to apply a release fluid on the surface of the fuser member, the improvement comprising a composite wicking material comprising a first layer which contacts the fuser member surface and a second layer adjacent the first layer and in contact therewith, the first and second layers having different compositions, with at least some of the material of at least one of the layers being forcefully driven into the material of the other layer by the process of needling.

2. The fuser assembly of claim 1 wherein the fuser member is a roll, the pressure member is a roll, the release fluid is a polysiloxane fluid, the composite wicking material comprises a fibrous polytetrafluoroethylene layer which contacts the fuser member surface and a fibrous heat resistant nylon adjacent the polytetrafluoroethylene layer and in contact therewith, and the fibrous polytetrafluoroethylene material is needled into the fibrous heat resistant nylon.

* * * * *